US007658518B2

(12) United States Patent
Shwisha

(10) Patent No.: US 7,658,518 B2
(45) Date of Patent: Feb. 9, 2010

(54) COVE LIGHTING

(75) Inventor: Gordon L. Shwisha, Westport, CT (US)

(73) Assignee: Electrix, Inc., New Haven, CT (US)

( * ) Notice: Subject to any disclaimer, the term of this patent is extended or adjusted under 35 U.S.C. 154(b) by 548 days.

(21) Appl. No.: 11/197,161

(22) Filed: Aug. 3, 2005

(65) Prior Publication Data

US 2007/0081325 A1 Apr. 12, 2007

(51) Int. Cl.
*F21S 8/00* (2006.01)
*F21S 4/00* (2006.01)

(52) U.S. Cl. ..... 362/432; 362/145; 362/147; 362/219; 362/223; 362/225; 248/227.1; 248/304

(58) Field of Classification Search ..... 362/432, 362/217, 218, 219, 145, 147, 225, 151, 221
See application file for complete search history.

(56) References Cited

U.S. PATENT DOCUMENTS 2,922,029 A * 1/1960 Eschelbach et al. ..... 362/151
4,725,931 A * 2/1988 Bourdon ..... 362/151
4,881,156 A 11/1989 Shemitz et al.
5,550,725 A 8/1996 Shemitz et al.
5,564,818 A * 10/1996 Grossman et al. ..... 362/221
5,713,657 A * 2/1998 Dearborn ..... 362/147
5,761,863 A * 6/1998 Sutt et al. ..... 52/272
5,765,939 A * 6/1998 Tanner, Jr. ..... 362/219
5,775,797 A * 7/1998 Henstra ..... 362/225
7,029,143 B2 * 4/2006 Kiechle et al. ..... 362/147
7,114,826 B1 * 10/2006 Lilly ..... 362/146
2005/0225982 A1 * 10/2005 Hahn ..... 362/252
2005/0243547 A1 * 11/2005 Cini et al. ..... 362/219
2007/0034150 A1 * 2/2007 Morton ..... 118/400

* cited by examiner

*Primary Examiner*—Sharon E Payne
*Assistant Examiner*—Sean P Gramling
(74) *Attorney, Agent, or Firm*—Bachman & LaPointe, P.C.

(57) ABSTRACT

A light apparatus is mounted to a wall of a building. At least one elongate mounting plate is engaged to the wall extending essentially horizontally along the wall. A number of brackets are mounted to the mounting plate and extend forward therefrom. One or more trim pieces are mounted generally below and in front of the brackets. A number of holding elements mount at least one light source to at least one of the elongate mounting plates and brackets.

30 Claims, 7 Drawing Sheets

COVE LIGHTING

BACKGROUND OF THE INVENTION

The invention relates to electric lighting. More particularly, the invention relates to light fixtures for indirect lighting.

Well-developed fields exist in indirect lighting and architectural lighting fixtures. A particular area of indirect lighting is known as cove lighting. In a typical cove lighting situation, an upwardly open channel structure is built along a wall near the ceiling. The wall may be a side wall of the room, a sidewall of a recess in the ceiling, a side surface of a beam, or the like. Light bulbs are mounted within the channels so that the emitted light escapes generally upward to directly light the wall and ceiling above and, indirectly, an interior of the room and its contents. The channels are built with conventional building techniques involving framing, sheetrocking/plastering, and the like.

Alternatives involve elongate fixtures used for cove lighting. Such fixtures typically include an elongate bulb within an elongate reflector positioned so that light from the bulb and reflector does not directly pass to objects within a room but, rather, is first diffusely reflected from a ceiling, wall, or other architectural feature. Such fixtures may be assembled end-to-end in lieu of placing fixtures within a preexisting channel. Exemplary systems are shown in U.S. Pat. Nos. 4,881,156 and 5,550,725.

SUMMARY OF THE INVENTION

Accordingly, one aspect of the invention involves a light apparatus. At least one elongate mounting plate is engaged to a surface of a building. A number of brackets are mounted to the at least one mounting plate and extend forward (i.e., away from the surface) therefrom. One or more trim pieces are mounted to the brackets. A number of holding elements mount at least one light source to at least one of the mounting plates and/or brackets.

Another aspect of the invention involves a light apparatus having at least one light source. Trim means at least partially obstruct the passage of light. First means are installable to a building wall for mounting a remainder of the apparatus to the wall. Second means attach to an installed first means and, thereafter, receive the trim means below and in front. Third means mount the light source to at least one of the first and second means.

Another aspect of the invention involves a method for assembling a light apparatus to a wall of a building. At least one mounting plate extrusion is secured to the wall. A number of extruded brackets are secured to the at least one mounting plate extrusion. One or more trim pieces are secured below and in front of the brackets. A number of bulb sockets are assembled to one or more of the brackets and/or mounting plate extrusions.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
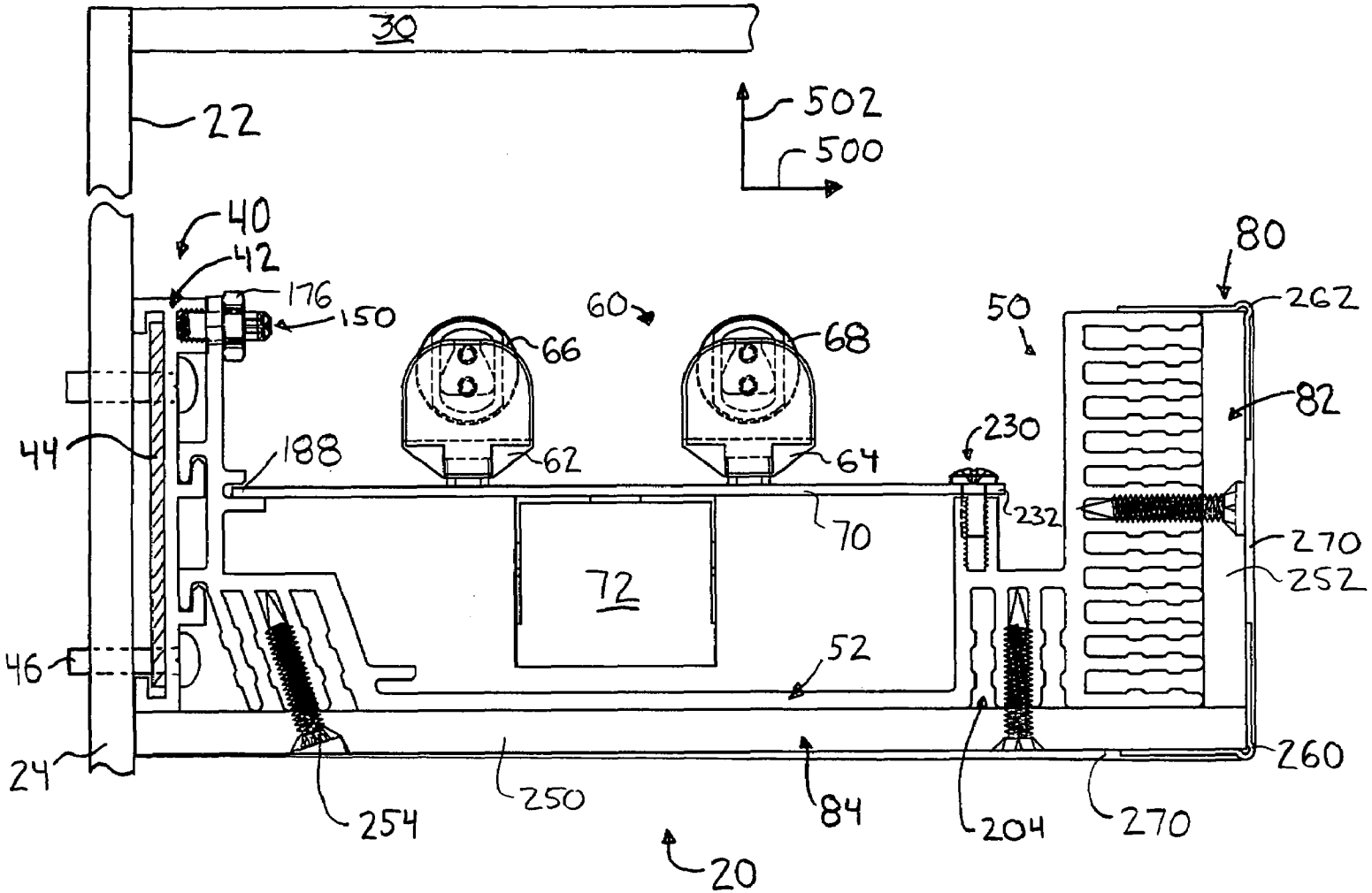
FIG. 1 is a sectional view of a cove light fixture.

FIG. 1 shows a light fixture assembly 20 mounted to a surface 22 of a wall 24. The wall may be a wall of a room, a wall of a ceiling cove, a side of a structural beam, or the like. The fixture assembly may be positioned adjacent to and slightly below a ceiling or ceiling portion 30. For convenient reference, a forward direction 500 is defined as away from the wall. An upward direction is shown as 502. With left and right defined from the point of view of a person standing upright and facing in the forward direction, the fixture assembly may extend from a left end to a right end. The assembly may include one, two, or more individual fixture units or subsystem units assembled or otherwise arranged end-to-end. This direction of assembly is identified as longitudinal.

The assembly 20 may comprise several subsystems. A first exemplary subsystem is a wall-mounting subsystem 40. The exemplary subsystem 40 includes an end-to-end array of mounting plates or brackets 42. Adjacent twos of the brackets are joined by connector plates 44 spanning their junctions. The brackets 42 may be secured to the wall 24 by fasteners 46 (e.g., screws, toggle fasteners, or the like). Further structural details of the exemplary subsystem 40 and brackets 42 are discussed below.

A second exemplary subsystem is a structural subsystem 50 comprising an array of spaced-apart brackets 52 mounted to the mounting brackets 42. Further structural details of the exemplary subsystem 50 and brackets 52 are discussed below.

A third subsystem is an electrical subsystem 60. The electrical subsystem includes aft and front receptacles 62 and 64 carrying bulbs 66 and 68. The receptacles 62 and 64 are mounted on and carried by a plate 70 which is attached to the structural subsystem 50. In FIG. 1, a ballast 72 is shown carried by the plate 70. Receptacle/plate/ballast combinations may be longitudinally arrayed end-to-end. In several alternative variations, a single ballast may power more than just the adjacent bulb(s). In other variations, there may be more complex interrelationship of the bulbs such as longitudinal staggering of the receptacles 62 and 64 to reduce dark spots.

A fourth subsystem is a trim subsystem 80 mounted to the structural subsystem 50. An exemplary trim subsystem includes a first portion 82 generally along the front of the unit and a second portion 84 generally along the bottom. The trim subsystem 80 provides a desired ornamental and/or architectural appearance.

Figure 2:
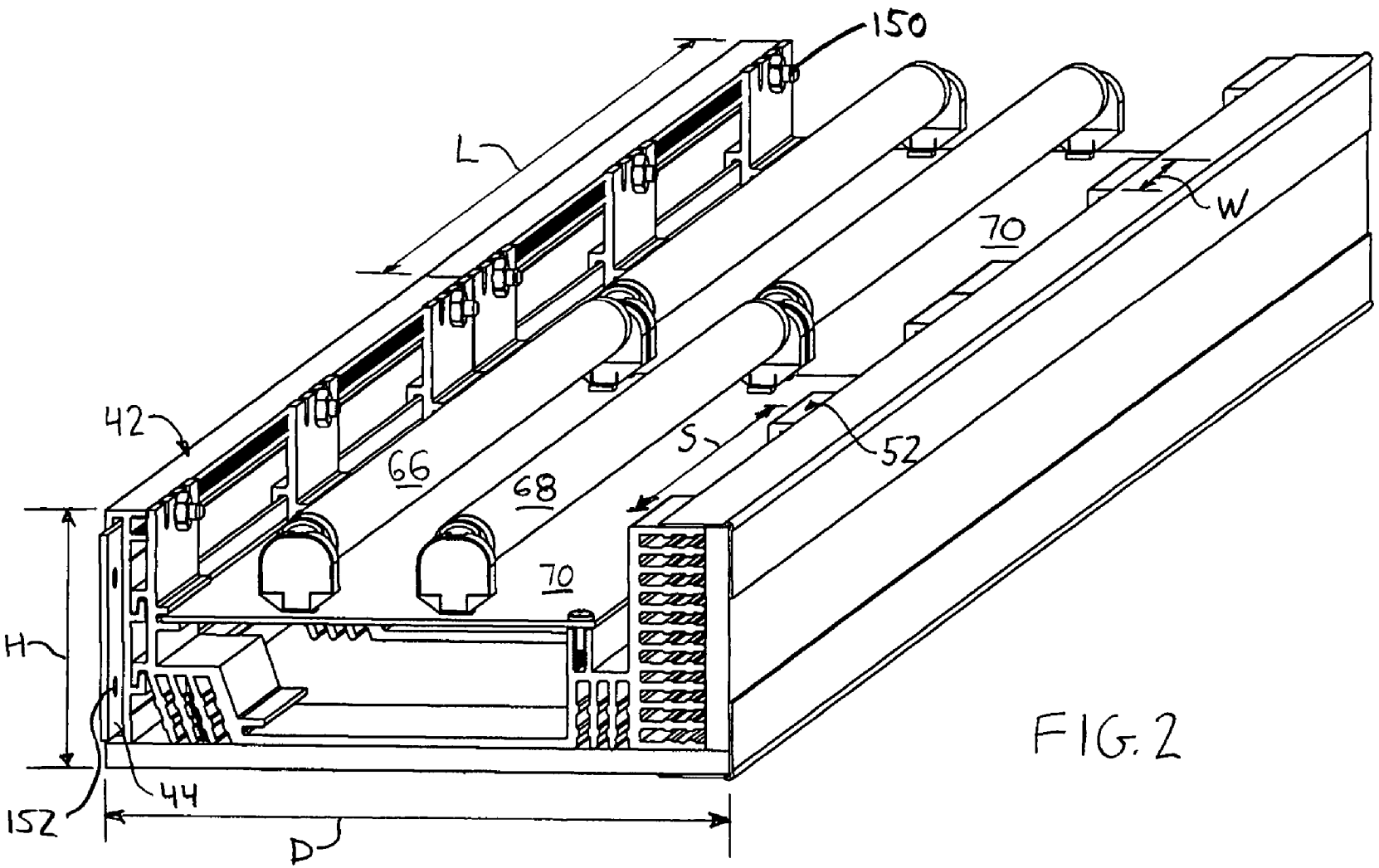
FIG. 2 is a view of a pair of fixtures of FIG. 1.

FIG. 2 shows an exemplary configuration wherein the mounting brackets 42 and the plates 70 have a similar length L. An exemplary length L for this configuration is nominally 3-12 feet. More broadly, advantageous L is at least twenty-two inches (more narrowly 90-96 inches to correspond to a nominal eight foot length). The exemplary plate 70 carries a single bulb 66 and the associated receptacle 62 and a single bulb 68 and the associated receptacle 64. The exemplary brackets 52 are shown having a bracket width W and an on-center spacing S. Exemplary W is 2-4 inches. Exemplary S is 12-32 inches (e.g., nominally 16 or 24 inch spacing for engaging wall studs). The exemplary fixture has a depth D and a height H. Exemplary D and H are 6-7.5 inch and 1-6 inch, respectively, Depth and height of the brackets 52 may be slightly less (e.g., approximately half an inch less).

Figure 3:
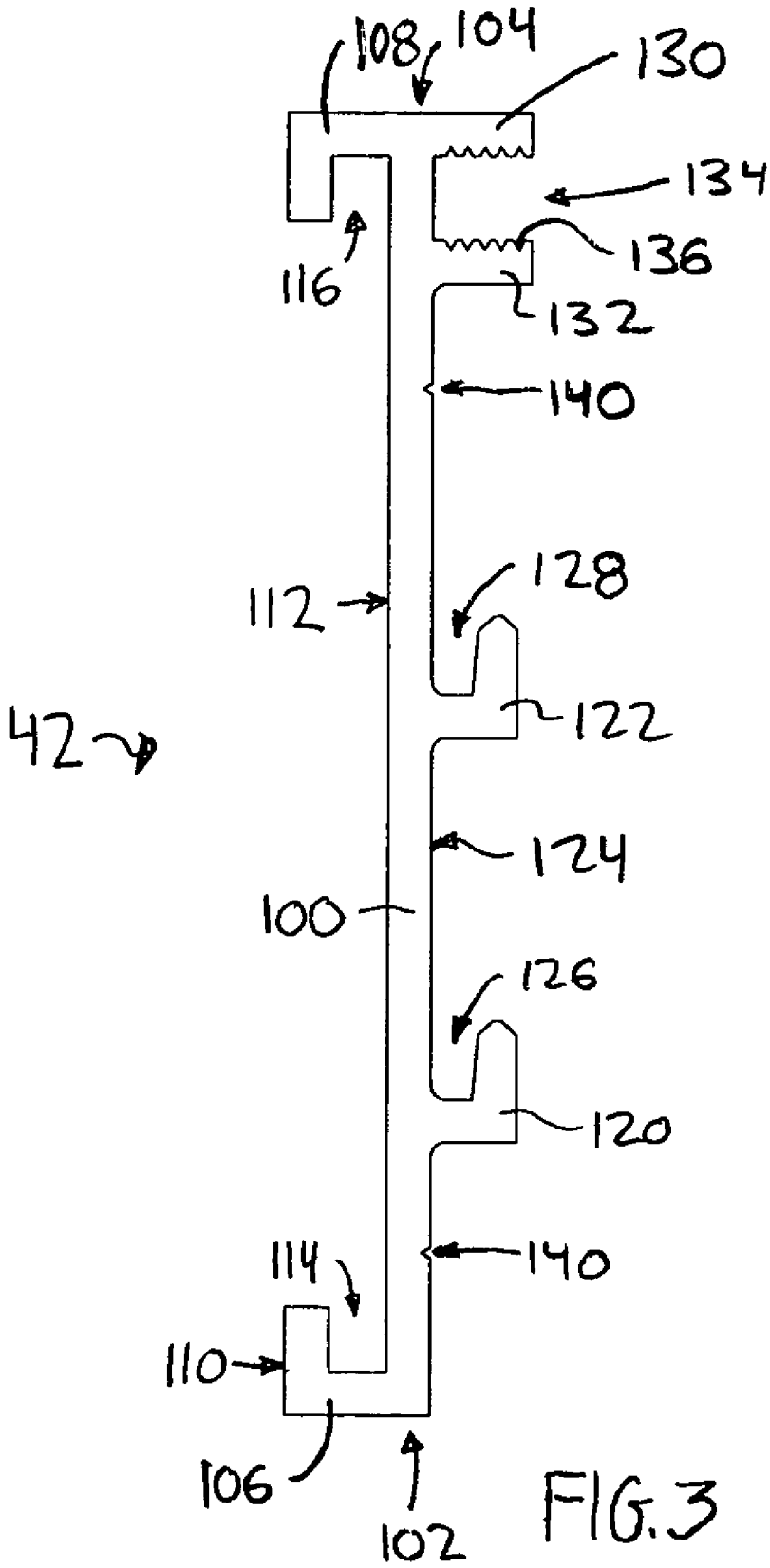
FIG. 3 is an end view of a mounting plate extrusion of the fixture of FIG. 1.

FIG. 3 shows further details of the mounting bracket 42. The bracket has a central vertical web 100 extending between a lower end 102 and an upper end 104. An aft pair of lower and upper L-sectioned rails 106 and 108 extend aft from the lower and upper ends. Aft surfaces 110 of the rails are positioned spaced apart from an aft surface 112 of the web 100. The aft surfaces 110 may engage the wall surface 22. The rails cooperate with the webs to form respective lower and upper channels 114 and 116 for receiving upper and lower edge portions of the plates 44. A forward pair of lower and upper L-sectioned rails 120 and 122 extend from the web forward surface 124. As is discussed in further detail below, these rails 120 and 122 cooperate with the web 100 to form channels 126 and 128 for receiving feet of associated rail portions of the brackets 52.

Along top end 104, a straight rail 130 extends forward from the web 100. Spaced slightly therebelow, a second straight rail 132 similarly extends so as to define a channel 134. A lower surface of the rail 130 and an upper surface of the rail 132 are pre-scored with serations 136 to improve retention of threaded studs (discussed below). A pair of upper and lower grooves 140 are provided in the forward surface 124 for aligning/guiding use of self-drilling wood screws as the fasteners 46 or guiding drilling for other fasteners.

As so far described, the bracket 42 may be formed by extrusion (e.g., of an aluminum alloy and cut to length. Pre-installation, threaded studs 150 (FIG. 2) may be screwed into the channel 134 at positions providing a desired spacing for the brackets 52 (as is discussed below). During initial installation, the brackets 42 may be screwed, one-by-one, to the wall surface. As each bracket is so-installed, an associated one of the plates 44 may be inserted into an exposed end of the bracket. The next bracket 42 may be inserted over the plate and similarly secured to the wall. The adjacent screws 46 (FIG. 1) may pass through holes 152 (FIG. 2) in the plates 44. The process may be repeated. One or more of the brackets 42 may be cut to length to accommodate a desired environment.

Figure 4:
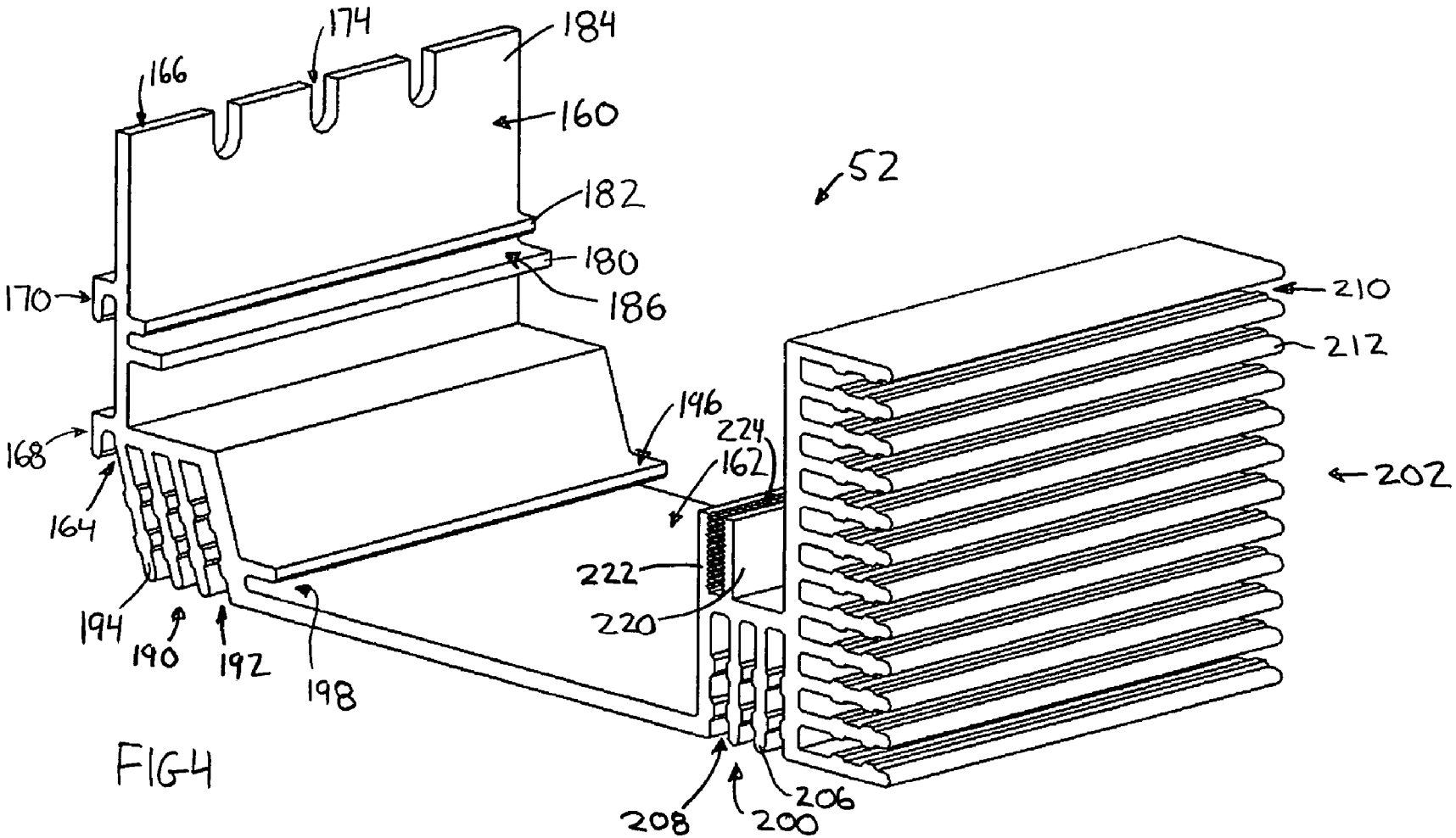
FIG. 4 is a view of a light support bracket of the fixture of FIG. 1.

FIG. 4 shows further details of a bracket 52. The bracket 52 includes an aft web 160 and a lower web 162. The aft end extends from a lower end 164 to an upper end 166. A pair of lower and upper L-sectioned rails 168 and 170 extend toes-downward from an aft surface 172 of the web 160. The rails 168 and 170 are positioned so that their feet may be received in the channels 126 and 128 of the bracket 42 of FIG. 3. A series of recesses 174 extend downward from the web upper end 166. In the exemplary embodiment, there are three such recesses. The recesses are dimensioned so that one of the recesses may receive the associated stud 150. A nut 176 (FIG. 1) may be secured over a distal threaded portion of the stud 150 to tightly secure the bracket. To permit convenient maintenance of a constant on-center bracket spacing S across the combined fixtures, the exemplary brackets 52 are provided with three such recesses 174. The center recess is typically used. However, for brackets 52 that span junctions between the brackets 42, one of the other recesses 174 might be used so that the bracket 52 may be centered along the junction.

A pair of lower and upper straight rails 180 and 182 extend forward from the front surface 184 of the web 160 to define a forwardly-open channel 186. The channel 186 may receive an aft edge portion 188 (FIG. 1) of the plate 70 when the electrical subsystem is installed. A fin array 190 forms a junction between the webs 160 and 162. A series of channels 192 are formed between adjacent pairs of the fins 194. The exemplary web 162 extends forward from a lower end of a forwardmost fin 194. In the exemplary bracket 52, a straight rail 196 extends forward from the forwardmost web 194. The rail 196 is spaced apart from the web 162 to define a forwardly-open channel 198. As is discussed in further detail below, the channel 198 may serve to capture an aft edge portion of an alternate electrical subsystem mounting plate.

A fin array 200 forms a junction between the web 162 and a fin array 202. A series of downwardly open channels 204 are formed between adjacent pairs of the fins 206 of the array 200. A forward end of the web 162 joins a lower end of an aftmost fin 206. A series of forwardly open channels 210 are formed between adjacent fins 212 of the array 202. As is discussed in further detail below, the channels 192, 204, and 210 may receive fasteners (e.g., screws) for mounting the trim subsystem. A pair of fore and aft straight rails 220 and 222 extend upward from a back of the array 200 to define an upwardly-open channel 224. Surfaces of the rails 220 and 222 facing the channel 224 may be pre-scored with serations to improve retention of fasteners 230 (FIG. 1), such as machine screws, passing through holes in a forward portion 232 of the plate 270 to secure the plate to the associated brackets 52. The exemplary fins 194, 206, and 212 have lateral ribs 234 for engaging the associated screws 254 (FIG. 1). The brackets 52 may be formed by extrusion (e.g., of an aluminum alloy) and cutting to the desired width. Alternatively, they may be individually cast. If cast, they could take very different forms, lacking the illustrated symmetry.

In an exemplary installation, the wall-mounting subsystem 40 may be initially installed (e.g., by a carpentry or sheetrocking contractor). That contractor may then install the brackets 52 and then install the trim subsystem 80. To do this, appropriate lengths of sheetrock 250 and 252 (FIG. 1) may be cut to fit generally below and in front of the brackets 52, respectively. The sheetrock 250 may be secured by countersunk drywall screws 254 in the channels 192 and 204. In the exemplary brackets 52, the channels 204 are essentially exactly vertically-extending. The channels 192, however, extend off-vertical at an acute angle θ (e.g., 10-30°) to permit convenient screwgun access. Similar dry wall screws 254 may be driven through the sheetrock 252 into the channels 210. A first corner bead 260 may be applied to a lower front edge of the trim system spanning a junction between the sheetrock 250 and 252. A second such bead 262 may be applied at the forward top edge (e.g., of the sheetrock 252) Joints between adjacent pieces of the sheetrock 250 may be taped as may joints between adjacent pieces of the sheetrock 252. Compound 270 (e.g., joint compound, plaster, or the like) may be applied over the sheetrock to provide a smooth surface for painting, papering, or the like. Alternatively to sheetrock, wood or other trim materials may be used.

In an exemplary installation sequence, after installation of the trim subsystem 80, a larger contractor may then install electrical subsystem 60. This may include wiring in addition to the mechanical installation of the plate and receptacle combinations.

Figure 5:
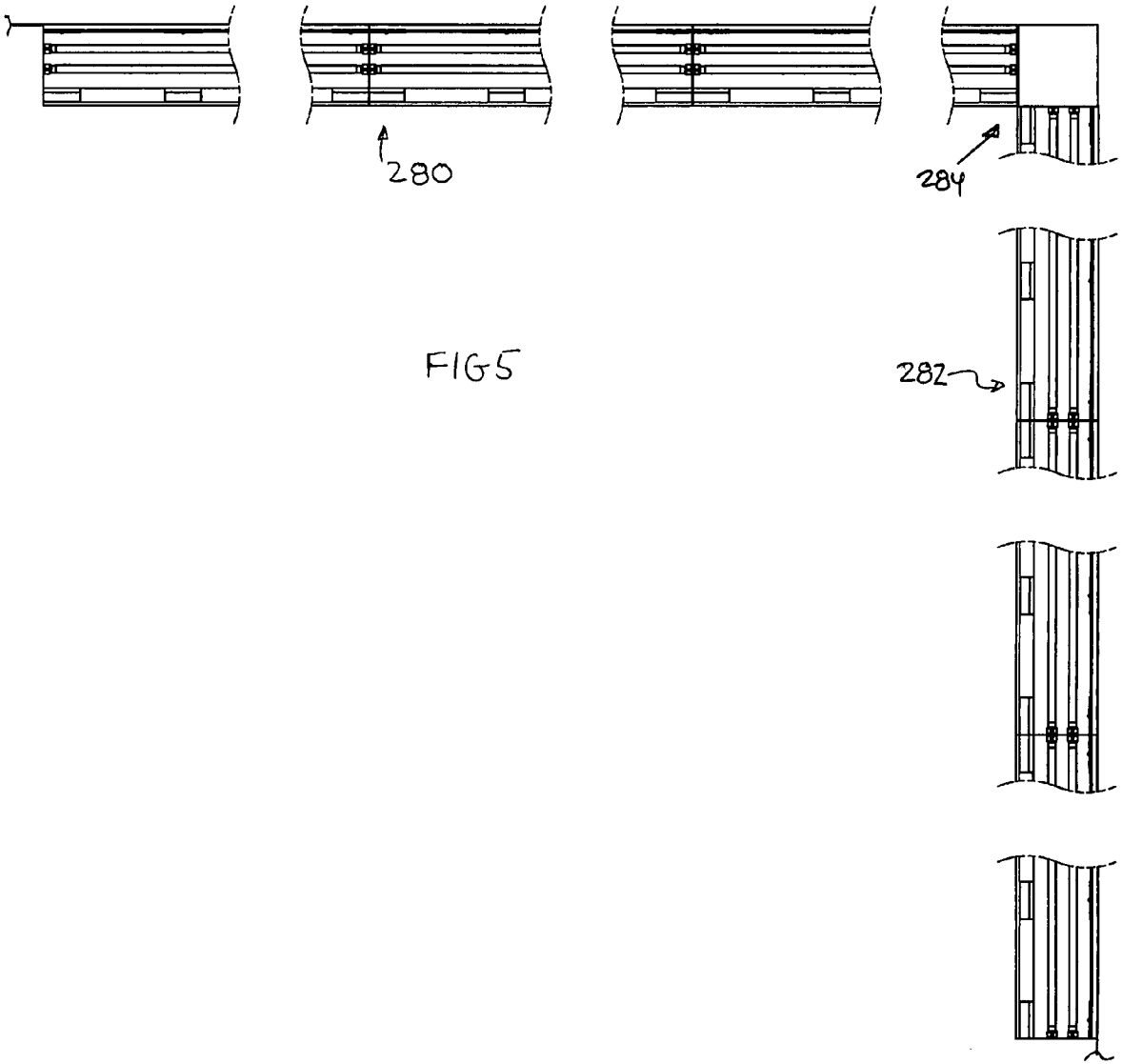
FIG. 5 is a top view of a pair of arrays of fixtures of FIG. 1.

FIG. 5 shows an installation where first and second linear arrays 280 and 282 of the fixtures extend from a junction 284 along an inside corner of a building. Each of the arrays may extend from a first end fixture to a second end fixture and have any number of intervening fixtures.

Figure 6:
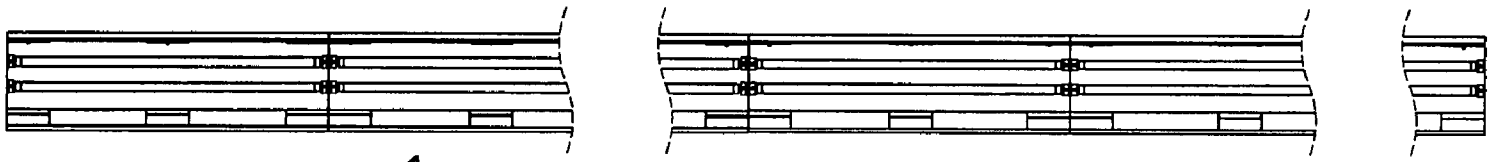
FIG. 6 is a top view of a linear array of first fixtures.
Figure 7:
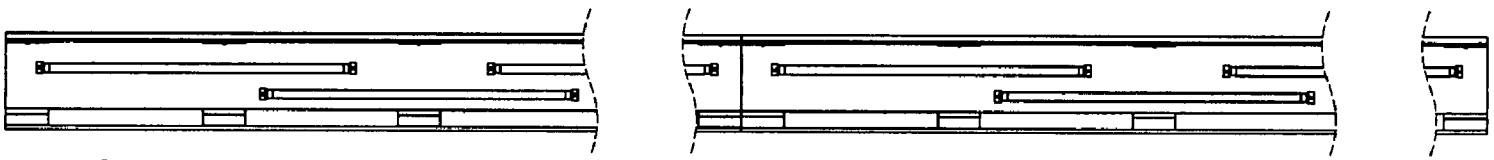
FIG. 7 is a top view of a linear array of second fixtures.
Figure 8:
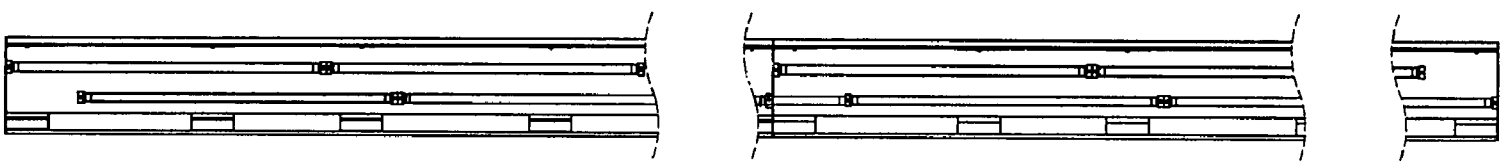
FIG. 8 is a top view of a linear array of third fixtures.

FIG. 6 shows a single linear array 286 of such fixtures. FIG. 7 shows an array 288 of alternate fixtures wherein the receptacles and bulbs are staggered. Each exemplary fixture has a pair of spaced-apart aft bulbs and a single forward bulb spanning a gap between the aft bulbs. Such staggering may be useful to provide a desired amount of light and to minimize dark spots. FIG. 8 shows an array 290 wherein each fixture has an end-to-end pair of aft bulbs and an end-to-end pair of front bulbs slightly staggered so as to reduce dark spots.

Figure 9:
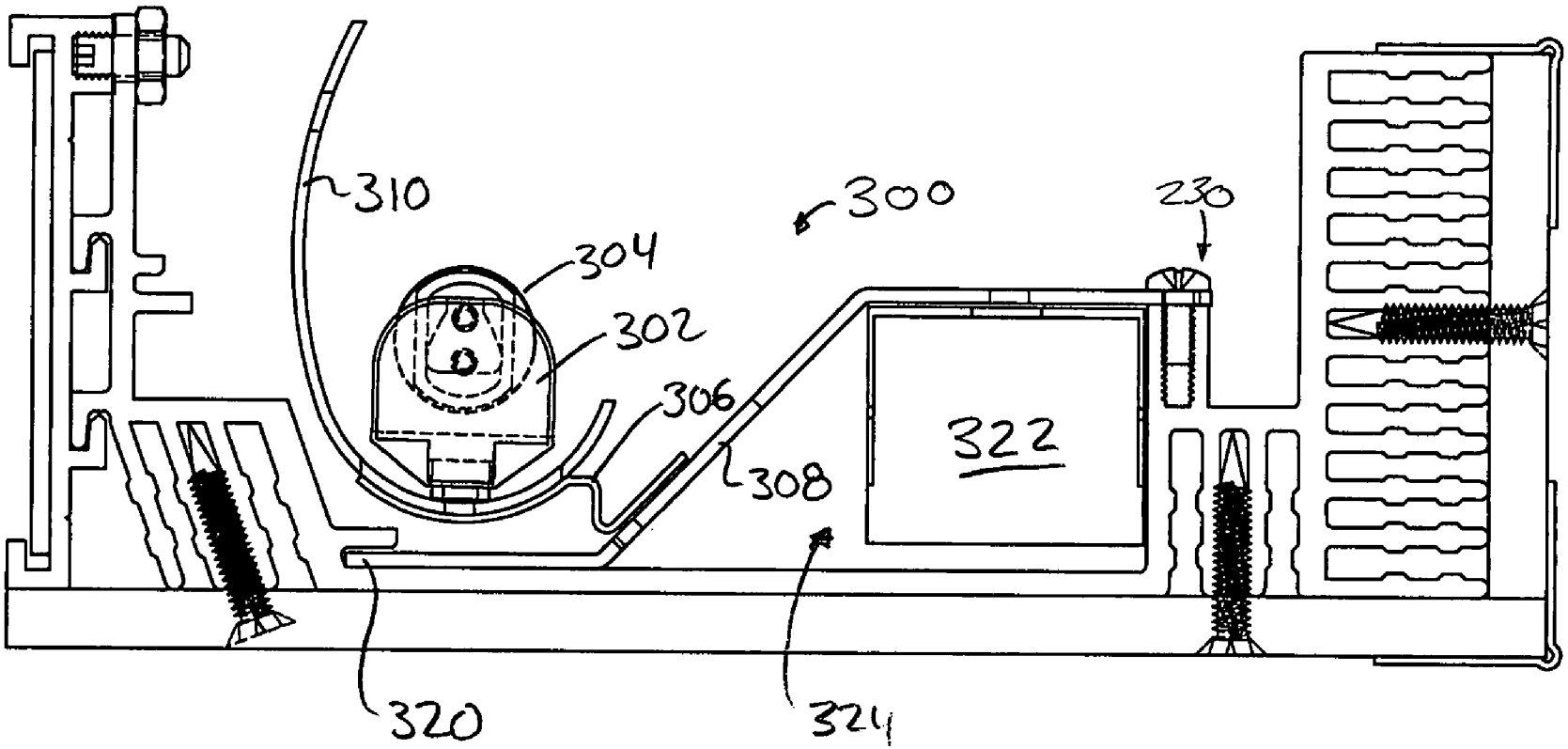
FIG. 9 is a sectional view of an alternate apparatus.

FIG. 9 shows an alternate electrical subsystem 300 wherein there is a single row of receptacles 302 and bulbs 304. The receptacles are carried by brackets 306 mounted to mounting plates 308. Pivotable reflectors 310 are mounted partially surrounding the bulbs and receptacles or may be oriented to direct light in a desired direction. As was noted above, an aft portion 320 of the plate 308 is captured in the channel 198. The ballast 322 is contained within a pocket 324 beneath the mounting plate 308. A forward portion of the plate 308 is secured by the screw 230 to the bracket 52.

One or more embodiments of the present invention have been described. Nevertheless, it will be understood that various modifications may be made without departing from the spirit and scope of the invention. For example, various elements may be combined or further separated. Additionally, a variety of structural shapes and cooperating features of the extrusion are possible. Various other manufacturing techniques and materials may be used. Multiple bulb and multiple reflector embodiments are also possible. Architectural/design considerations may influence any particular implementation, giving rise to the possibility of mounting on non-vertical surfaces and mounting in non-horizontally extending arrays. Accordingly, other embodiments are within the scope of the following claims.

What is claimed is:

1. A light apparatus mounted to a surface of a building and comprising:

at least one light source;

at least one elongate mounting plate engaged to the surface, a plurality of adjacent pairs of said mounting plates are interlocked by alignment plates received in each of the mounting plates of the associated pair;

a plurality of extruded brackets mounted to the at least one elongate mounting plate and extending forward therefrom so as to be mounted to the surface by the at least one elongate mounting plate;

one or more trim pieces mounted to the brackets; and a plurality of holding elements mounting the at least one light source to at least one of the at least one elongate mounting plate and the plurality of brackets.

2. The apparatus of claim 1 wherein:

the surface is a wall;

the at least one elongate mounting plate extends essentially horizontally along the wall; and the one or more trim pieces are mounted generally below and in front of the brackets.

3. The apparatus of claim 1 wherein:

the at least one light source comprises a plurality of elongate fluorescent light bulbs.

4. The apparatus of claim 1 wherein:

the plurality of extruded brackets consist essentially of first metallic extrusions; and the at least one elongate mounting plate comprises at least one second metallic extrusion.

5. The apparatus of claim 1 wherein:

the one or more trim pieces comprise at least a first piece generally below at least an associated pair of the brackets and screwed thereto; and at least a second piece generally in front of at least an associated pair of the brackets and screwed thereto.

6. The apparatus of claim 5 wherein:

the first and second pieces comprise, in major volume part, cementaceous or fibrous material or combinations thereof.

7. The apparatus of claim 5 wherein:

the first piece is screwed to each of the associated pair of brackets by:

a forward screw substantially normal to a face of the first piece; and a rear screw extending off-normal to said face by an angle of 10-50°.

8. The apparatus of claim 5 wherein:

the first and second pieces are spanned by a corner bead member.

9. The apparatus of claim 1 wherein:

the plurality of holding elements each comprise:

an aft portion captured in a receiving channel in at least an associated one of the brackets; and a fore portion secured to at least an associated one of the brackets.

10. The apparatus of claim 1 wherein:

at least one of the holding elements covers a ballast.

11. The apparatus of claim 1 wherein:

the plurality of holding elements comprise:

at least one metal support; and at least one receptacle mounted to the support; and at least one ballast is positioned below at least a first of the at least one metal support.

12. The apparatus of claim 5 wherein:

the first piece is screwed to each of the associated pair of brackets by:

a forward screw extending into a forward channel in the associated pair of brackets; and a rear screw extending off-normal to said face by an angle of 10-50° and into a rear channel in the associated pair of brackets.

13. The apparatus of claim 1 wherein:

the brackets each have at least one fin array;

the one or more trim pieces are secured to the associated brackets by screws extending into channels formed by the at least one fin array.

14. A method for assembling a light apparatus to a surface of a building comprising:

securing at least one mounting plate extrusion to the surface;

engaging a plurality of extruded brackets to the at least one mounting plate extrusion so as to be mounted to the surface by the at least one elongate mounting plate, the engaging the plurality of extruded brackets comprising:

aligning the brackets with positioning features on the least one mounting plate extrusion, the positioning features being threaded studs laterally aligning the extruded brackets along the at least one mounting plate; and securing the brackets to the least one mounting plate extrusion with fasteners, the fasteners comprising nuts engaged to the studs;

securing one or more trim pieces to the extruded brackets; and assembling a plurality of bulb sockets to at least one of the extruded brackets and the mounting plate extrusions.

15. The method of claim 14 wherein:

the one or more trim pieces are secured below and in front of the extruded brackets.

16. The method of claim 14 wherein:

the securing of the trim pieces comprises screwing into the extruded brackets;

the assembling comprises assembling a ballast and the bulb sockets to the extruded brackets.

17. The method of claim 14 wherein:
the surface is a surface of a wall; and
the securing the at least one mounting plate extrusion to the surface comprises:
screwing a first mounting plate extrusion to the wall;
assembling a connector to the first mounting plate extrusion;
assembling a second mounting plate extrusion to the connector; and
screwing the second mounting plate extrusion to the wall.

18. The method of claim 14 wherein:
the securing one or more trim pieces comprises:
screwing at least a first piece generally below at least an associated pair of the extruded brackets; and
screwing at least a second piece generally in front of at least an associated pair of the extruded brackets.

19. The method of claim 18 wherein:
the securing one or more trim pieces comprises:
taping a joint between first and second of the one or more trim pieces; and,
applying a joint compound over the tape.

20. The method of claim 14 wherein:
said securing at least one mounting plate extrusion to the surface is before the engaging.

21. A light apparatus mounted to a surface of a building and comprising:
at least one light source;
a plurality of elongate mounting plates engaged to the surface, a plurality of adjacent pairs of said mounting plates interlocked by alignment plates received in each of the elongate mounting plates of the associated pair;
a plurality of extruded brackets mounted to the elongate mounting plates and extending forward therefrom;
one or more trim pieces mounted to the brackets; and
a plurality of holding elements mounting the at least one light source to at least one of the plurality of elongate mounting plates and the plurality of brackets.

22. A light apparatus mounted to a surface of a building and comprising:
at least one light source;
at least one elongate mounting plate engaged to the surface;
a plurality of brackets mounted to the at least one elongate mounting plate and extending forward therefrom;
one or more trim pieces mounted to the brackets; and
a plurality of holding elements mounting the at least one light source to at least one of the at least one elongate mounting plate and the plurality of brackets, wherein:
the plurality of holding elements each comprise:
an aft portion captured in a receiving channel in at least an associated one of the brackets; and
a fore portion secured to at least an associated one of the brackets with a fastener wherein aft and fore are relative to the surface of the building.

23. A method for assembling a light apparatus to a surface of a building comprising:
securing at least one mounting plate extrusion to the surface;
engaging a plurality of extruded brackets to the at least one mounting plate extrusion;
securing one or more trim pieces to the extruded brackets; and
assembling a plurality of bulb sockets to at least one of the extruded brackets and the mounting plate extrusions, wherein:
the surface is a surface of a wall; and
the securing the at least one mounting plate extrusion to the surface comprises:
screwing a first mounting plate extrusion to the wall;
assembling a connector to the first mounting plate extrusion;
assembling a second mounting plate extrusion to the connector; and
screwing the second mounting plate extrusion to the wall.

24. The method of claim 23 wherein:
the securing one or more trim pieces comprises:
screwing at least a first piece generally below at least an associated pair of the extruded brackets; and
screwing at least a second piece generally in front of at least an associated pair of the extruded brackets;
taping a joint between first and second of the one or more trim pieces; and
applying a joint compound over the tape.

25. The method of claim 23 wherein:
the engaging the plurality of extruded brackets comprises:
aligning the brackets with positioning features on the least one mounting plate extrusion; and
securing the brackets to the least one mounting plate extrusion with fasteners.

26. A light apparatus mounted to a surface of a building and comprising:
at least one light source;
at least one elongate mounting plate engaged to the surface;
a plurality of brackets mounted to the at least one elongate mounting plate and extending forward therefrom so as to be mounted to the surface by the at least one elongate mounting plate, the brackets each having at least one fin array;
one or more trim pieces mounted to the brackets and secured thereto by screws extending into channels formed by the at least one fin array; and
a plurality of holding elements mounting the at least one light source to at least one of the at least one elongate mounting plate and the plurality of brackets.

27. A light apparatus mounted to a surface of a building and comprising:
at least one light source;
at least one elongate mounting plate engaged to the surface;
a plurality of extruded brackets mounted to the at least one elongate mounting plate and extending forward therefrom so as to be mounted to the surface by the at least one elongate mounting plate;
one or more trim pieces mounted to the brackets, the one or more trim pieces comprising:
at least a first piece generally below at least an associated pair of the brackets and screwed thereto by:
a forward screw extending into a forward channel in the associated pair of brackets; and
a rear screw extending off-normal to said face by an angle of 10-50° and into a rear channel in the associated pair of brackets; and
at least a second piece generally in front of at least an associated pair of the brackets and screwed thereto; and
a plurality of holding elements mounting the at least one light source to at least one of the at least one elongate mounting plate and the plurality of brackets.

28. The method of claim 14 wherein:
the securing of the trim pieces comprises screwing into the extruded brackets; and the assembling comprises assembling a ballast and the bulb sockets to the extruded brackets.

29. The method of claim 23 wherein:

the securing of the trim pieces comprises screwing into the extruded brackets; and the assembling comprises assembling a ballast and the bulb sockets to the extruded brackets.

30. The apparatus of claim 22 wherein:

the fastener comprises a screw.

* * * * *

UNITED STATES PATENT AND TRADEMARK OFFICE

CERTIFICATE OF CORRECTION

PATENT NO. : 7,658,518 B2
APPLICATION NO. : 11/197161
DATED : February 9, 2010
INVENTOR(S) : Gordon L. Shwisha It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 725 days.

Signed and Sealed this

Twenty-eighth Day of December, 2010

David J. Kappos

David J. Kappos
*Director of the United States Patent and Trademark Office*